US008351825B2

(12) United States Patent
Kimura et al.

(10) Patent No.: US 8,351,825 B2
(45) Date of Patent: Jan. 8, 2013

(54) IMAGE FORMING APPARATUS AND IMAGE FORMING METHOD

(75) Inventors: Hideki Kimura, Ebina (JP); Tomoshi Hara, Ebina (JP); Masahiko Kubo, Ebina (JP); Toshihiro Matsumoto, Ebina (JP); Nobukazu Takahashi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 408 days.

(21) Appl. No.: 12/547,994

(22) Filed: Aug. 26, 2009

(65) Prior Publication Data

US 2010/0202789 A1 Aug. 12, 2010

(30) Foreign Application Priority Data

Feb. 6, 2009 (JP) ..... 2009-025559

(51) Int. Cl.
*G03G 15/16* (2006.01)

(52) U.S. Cl. ..... 399/222; 399/223; 399/231

(58) Field of Classification Search ..... 399/39, 399/40, 222, 223, 224, 231
See application file for complete search history.

(56) References Cited

U.S. PATENT DOCUMENTS

2008/0160435 A1* 7/2008 Lim et al. ..... 430/48

FOREIGN PATENT DOCUMENTS

JP 2002-207334 A 7/2002

* cited by examiner

*Primary Examiner* — Walter L. Lindsay
*Assistant Examiner* — Barnabas Fekete
(74) *Attorney, Agent, or Firm* — Sughrue Mion, PLLC

(57) ABSTRACT

An image forming apparatus is provided and includes: an image forming unit that forms an image on an image carrier with a transparent material and a coloring material; a controller that controls an order of an image forming with the transparent material and an image forming with the coloring material to be different between in an image portion and in a non-image portion in an image forming region on the image carrier; and a transferring unit that transfers the image formed on the image carrier onto a recording medium.

10 Claims, 7 Drawing Sheets

IMAGE PORTION

NON-IMAGE PORTION

IMAGE FORMING APPARATUS AND IMAGE FORMING METHOD

CROSS-REFERENCE TO RELATED APPLICATION

This application is based on and claims priority under 35 USC §119 from Japanese Patent Application No. 2009-025559 filed Feb. 6, 2009.

BACKGROUND (i) Technical Field

The present invention relates to an image forming apparatus and an image forming method.

(ii) Related Art

An image forming apparatus using an electrophotographic method forms an image by utilizing a toner which is a coloring material on an image carrier such as a photosensitive drum or an intermediate belt and transfers the toner image thus formed onto a recording medium such as a printing paper, thereby forming an image on the recording medium.

An image portion corresponding to the toner image formed by the coloring material and a non-image portion in which a ground (a ground color) of the recording medium appears unchanged are present together in an image forming region on the image carrier. It has been known that a so-called "toner fog" might be generated, that is, a slight amount of the toner which is the coloring material might become attached to the non-image portion though it is not put thereon intentionally.

However, a processing for controlling the fog preventing potential is complicated. In particular, it is supposed that a perfect control is almost impossible when the configuration of the image and non-image portions is detailed. Furthermore, occurrence of secondary problems such as an image defect might also be increased.

SUMMARY

According to an aspect of the invention, there is provided an image forming apparatus including:

an image forming unit that forms an image on an image carrier with a transparent material and a coloring material;

a controller that controls an order of an image forming with the transparent material and an image forming with the coloring material to be different between in an image portion and in a non-image portion in an image forming region on the image carrier; and a transferring unit that transfers the image formed on the image carrier onto a recording medium.

DETAILED DESCRIPTION

Image forming apparatuses according to exemplary embodiments of the invention will be described below with reference to the drawings.

In all exemplary embodiments, the image forming apparatus which will be described below serves to output an image onto a recording medium by an electrophotographic method, and more specifically, is used as a copying machine or a printer apparatus. Examples of the recording medium to which the image is to be output include printing paper such as plain paper, recycled paper, or an OHP sheet; the type is not particularly restricted, but the following description will refer to the recording medium as "paper".

First Exemplary Embodiment

First of all, description will be given to an image forming apparatus according to a first exemplary embodiment of the invention.

Figure 1:
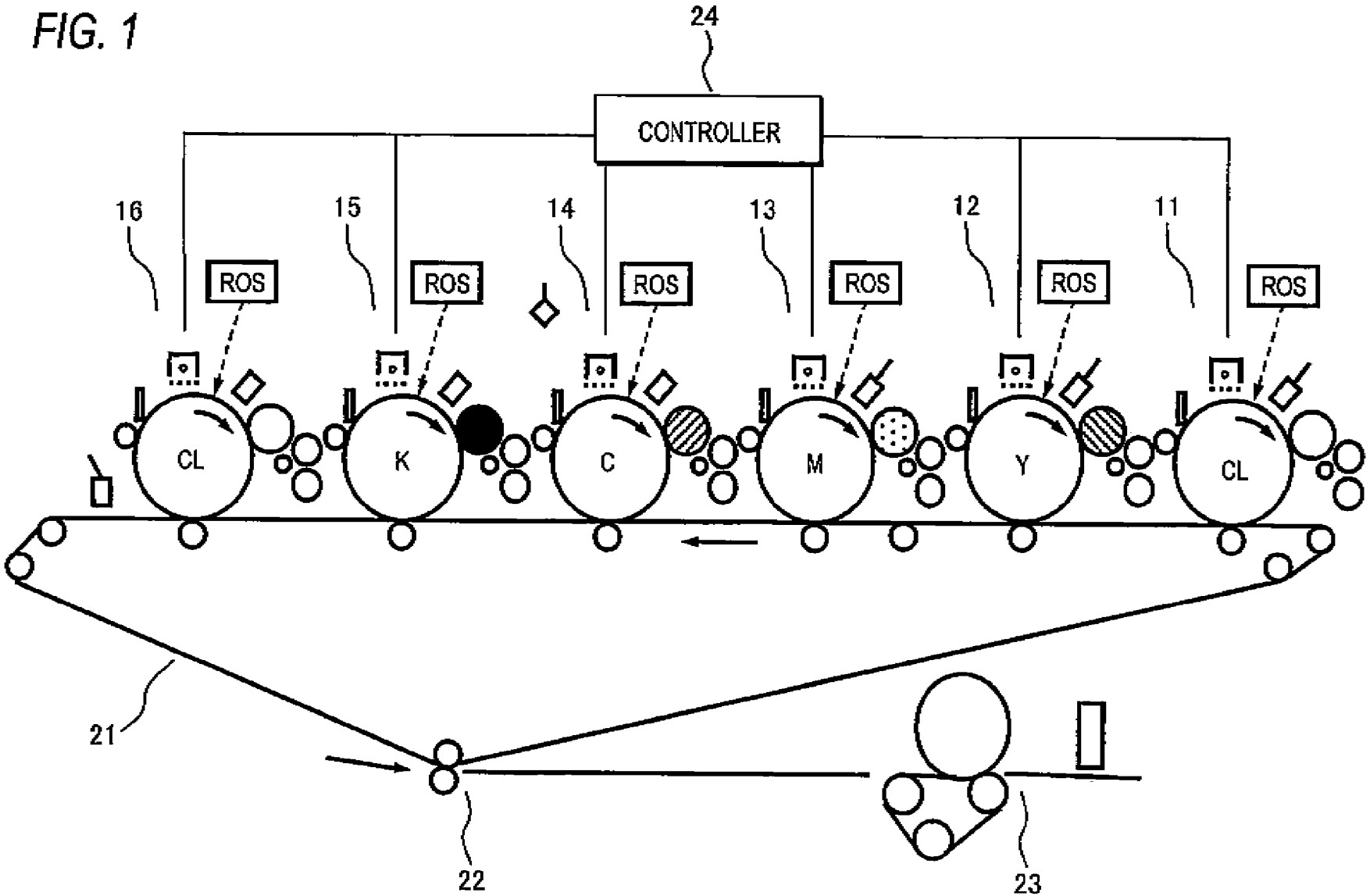
FIG. 1 is an explanatory view showing a structure of a main part in an image forming apparatus according to a first exemplary embodiment of the invention.

FIG. 1 is an explanatory view showing a structure of a main part in the image forming apparatus according to the first exemplary embodiment of the invention.

The image forming apparatus shown in FIG. 1 includes a plurality of (more specifically, six) image forming portions 11 to 16, an intermediate belt 21 which is an image carrier, a secondary transferring device 22, a fixing device 23, and a controller 24 for controlling the operations. In other words, the image forming apparatus shown in FIG. 1 employs a so-called "tandem system" in which the six image forming portions 11 to 16 are arranged in a line.

All of the image forming portions 11 to 16 form images through the processes of charging, exposure, development and transfer. For this purpose, each of the image forming portions 11 to 16 has a photosensitive drum serving as an image carrier which is rotated and driven, a charging device for uniformly charging the surface of the photosensitive drum, an exposing device (ROS) for forming an electrostatic latent image on the surface of the photosensitive drum, a developing device for developing the electrostatic latent image on the photosensitive drum into a toner image, a primary transferring device for transferring the toner image on the photosensitive drum onto the intermediate belt 21, and a cleaning device for removing foreign substances such as the toner remaining on the photosensitive drum. Since the details of the respective components are well-known, description thereof will be omitted.

The image forming portions 11 to 16 serve to form images by using different coloring materials (toners). More specifically, the four image forming portions 12 to 15 in the image forming portions 11 to 16 arranged in a line which are not at one of the ends form images using coloring materials (color toners) corresponding to yellow (Y), magenta (M) cyan (C) and black (K) colors, respectively. On the other hand, the two image forming portions 11 and 16 positioned at the ends form images by using a clear toner (CL) which is a transparent material.

In other words, each of the image forming portions 11 to 16 functions as image forming unit for forming an image by using the clear toner which is the transparent material and the color toner which is the coloring material.

Of the image forming portions 11 and 16 using the clear toner, the image forming portion 11 positioned upstream in the direction of the intermediate belt 21 carrying movement functions as a first transparent image-forming portion, and the image forming portion 16 positioned downstream in the carrying direction functions as a second transparent image-forming portion, as will be described below in detail.

The intermediate belt 21 is formed into an endless belt and is circulated and driven at a uniform speed, passing through the primary transferring device in each of the image forming portions 11 to 16, and a toner image formed by each of the image forming portions 11 to 16 is transferred and superposed thereon. For the intermediate belt 21, there may be provided a cleaning device for removing foreign substances such as a toner remaining on the intermediate belt 21 or paper dust.

The secondary transferring device 22 serves to transfer the toner image on the intermediate belt 21, which is the image carrier, onto the paper, which is the recording medium. In other words, the secondary transferring device 22 functions as transferring means for transferring the toner image from the intermediate belt 21 onto the paper.

The fixing device 23 serves to execute a fixing process in the electrophotographic method, that is, to carry out a fixation processing through application of heat and pressure on the paper to which the toner image has been transferred through the secondary transferring device 22, thereby fixing the image transferred onto the paper.

Since the intermediate belt 21, the secondary transferring device 22 and the fixing device 23 are well-known, detailed description of constituent materials and operating principles will be omitted.

The controller 24 includes a CPU (Central Processing Unit) functioning as a microcomputer, and serves to control operations in the portions 11 to 16 and 21 to 23 to carry out a processing for outputting an image onto the paper.

An operation control to be carried out by the controller 24 will be described below.

The controller 24 recognizes the distinction between an image portion and a non-image portion, referring to image information which is the basis for forming an image in each of the image forming portions 11 to 16. Here, the "image portion" is a portion in which a toner image is formed by a color toner in the image forming region on the image carrier, that is, the portion corresponding to the toner image itself. On the other hand, the "non-image portion" a the portion in the image forming region on the image carrier in which the toner image is not formed by the color toner, that is, the portion in which a ground of the paper (ground color or background color) appears as is. It can be supposed that the distinction between the image portion and the non-image portion is recognized depending on whether the value of image information for each pixel is "0" or "1", for example. The invention is not restricted thereto but the recognition may be carried out by other methods.

In the controller 24, when the distinction between the image portion and the non-image portion is recognized, an operating instruction is given to each of the image forming portions 11 to 16 in order to cause the order of formation of the clear toner and the color toner in the image portion and the non-image portion to differ, based on the result of the recognition. In other words, the controller 24 functions as forming order controlling means for controlling the order of images formed by the image forming portions 11 to 16.

Figure 2A:
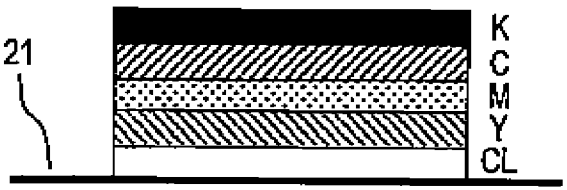
FIGS. 2A and 2B are explanatory views showing an operation control related to an image forming order according to the first exemplary embodiment of the invention.
Figure 2A:
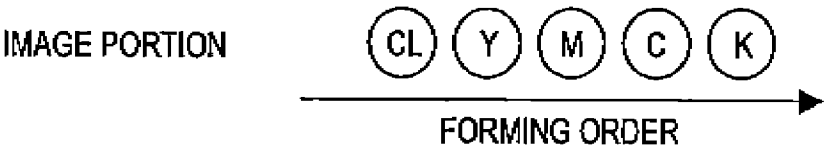
Figure 2B:
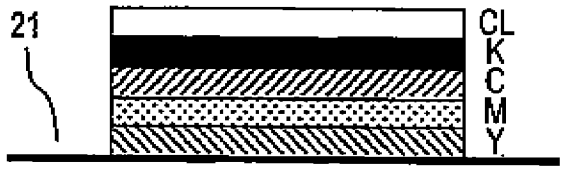
Figure 2B:
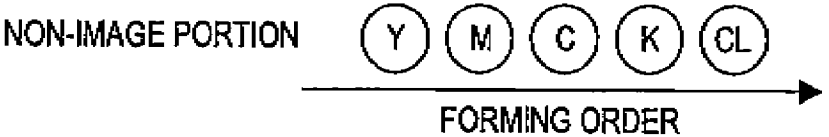

FIGS. 2A and 2B are explanatory views showing an operation control related to an image forming order according to the first exemplary embodiment of the invention.

As shown in FIG. 2A, in the case in which an image is formed for the image portion, the controller 24 gives an operating instruction of image forming to the image forming portion 11 which is the first transparent image-forming portion which forms a toner image with a clear toner, the image forming portion 12 for forming a toner image with a Y-color toner, the image forming portion 13 for forming a toner image with an M-color toner, the image forming portion 14 for forming a toner image with a C-color toner, and the image forming portion 15 for forming a toner image with a K-color toner. The image forming instruction is not given to the image forming portion 16 for functioning as a second transparent image-forming portion forming a toner image with a clear toner. Consequently, the image forming region on the intermediate belt 21 passes through the primary transferring devices in the image forming portions 11 to 16 in that order so that the toner image formed with the clear toner, the Y-color toner image, the M-color toner image, the C-color toner image and the K-color toner image are stacked over the intermediate belt 21 in that order starting from the intermediate belt 21 surface.

As shown in FIG. 2B, moreover, in the case in which an image is formed in the non-image portion, the controller 24 gives operating instructions of image forming in the image portion to the image forming portion 12 for forming a toner image with the Y-color toner, the image forming portion 13 for forming a toner image with the M-color toner, the image forming portion 14 for forming a toner image with the C-color toner, and the image forming portion 15 for forming a toner image with the K-color toner, and then gives an operating instruction to the image forming portion 16 functioning as the second transparent image-forming portion to form a toner image with the clear toner in the non-image portion. An instruction to form an image is not given to the image forming portion 11 functioning as the first transparent image-forming portion forming a toner image with the clear toner. Consequently, the image forming region provided on the intermediate belt 21 passes through the primary transferring devices in the image forming portions 11 to 16 in order so that the Y-color toner image, the M-color toner image, the C-color toner image, the K-color toner image and a toner image formed with the clear toner are stacked on the intermediate belt 21 in that order from the intermediate belt 21 surface.

In other words, in carrying out the operation control related to the image forming order, the controller 24 sets a formation order applying the color toners after the clear toner in the image portion. On the other hand, the controller 24 sets a forming order in which the clear toner for the non-image portion is applied last. Thus, the forming orders of the clear toner and the color toners in the image portion and the non-image portion are caused to be different.

Figure 3A:
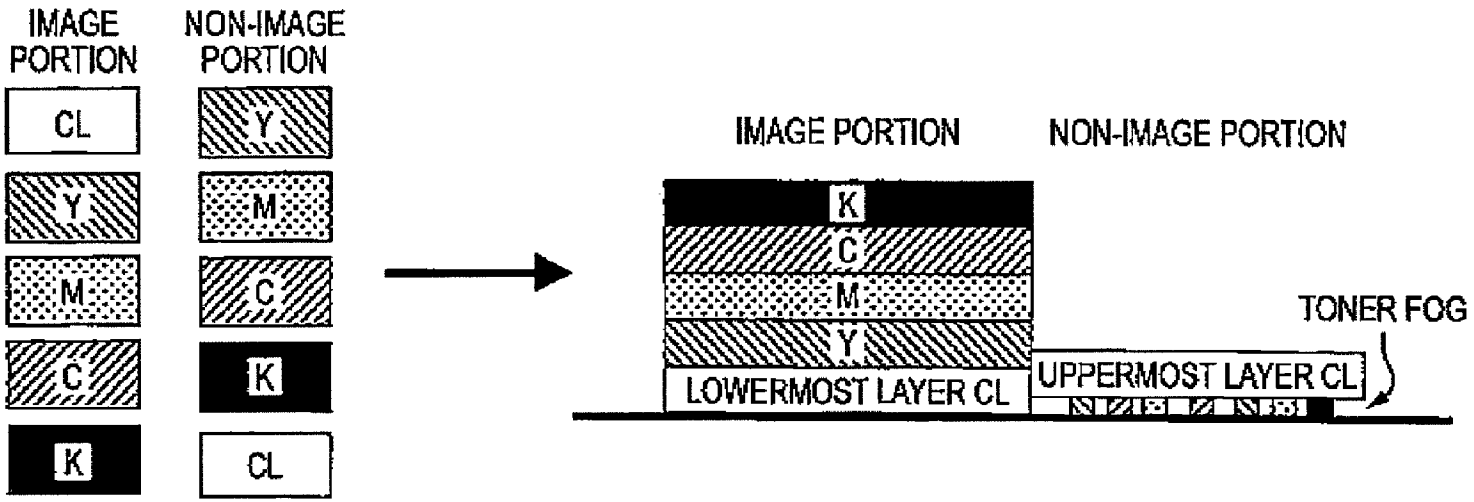
FIGS. 3A and 3B are explanatory views showing an image transferring operation in the case in which a toner image is transferred onto a paper.
Figure 3B:
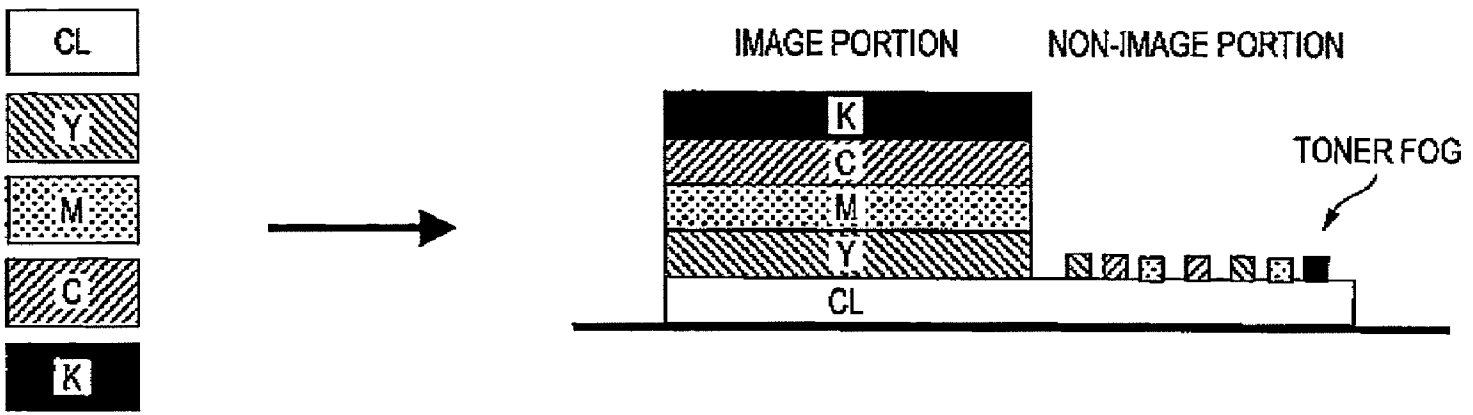
FIG. 3B RELATED ART

FIGS. 3A and 3B are explanatory views showing a transferring operation in the case in which a toner image is transferred onto a paper. In FIG. 3B, a specific example of a transferring operation in the structure in the background art is also shown for comparison.

As shown in FIG. 3B, in case of the structure in the background art, the toner image is formed with the clear toner, the Y-color toner image, the M-color toner image, the C-color toner image and the K-color toner image in that order from the surface of the belt whether it is the image portion or the non-image portion. Therefore, the clear toner is present on the entire surface of the belt. Thus, the transferring property of the color toner image onto the paper is enhanced in the non-image portion as well. In other words, a fog toner in the non-image portion is also transferred efficiently so that the toner fog becomes an actual image on the paper.

On the other hand, in an image forming apparatus according to the invention, the forming orders of the clear toner and the color toners in the image portion and in the non-image portion are different, as shown in FIG. 3A.

In the image portion, a clear toner layer is positioned as the lowermost layer on the intermediate belt 21. Therefore, the color toner layers superposed on the clear toner layer are efficiently transferred onto the paper.

On the other hand, in the non-image portion, the forming order is set so that the clear toner is applied last. Therefore, the clear toner layer is positioned on the uppermost layer on the intermediate belt 21. Accordingly, even if a fog toner happens to be present in the non-image portion, the clear toner layer is not below the fog toner. As opposed to the image portion, therefore, the transfer efficiency of the fog toner onto the paper is not enhanced. As a result, it is possible to suppress the transfer of the fog toner to the paper.

In addition, the clear toner layer is positioned as the lowermost layer on the intermediate belt 21 in the image portion, and furthermore, is positioned as the uppermost layer on the intermediate belt 21 in the non-image portion. In other words, the clear toner layer is positioned in both the image portion and the non-image portion.

After the transfer of the color toner image onto the paper, accordingly, the clear toner layer is transferred to both the image portion and the non-image portion over the paper. Consequently, it is possible to prevent a difference from arising between the image portion and the non-image portion with regard to the glossy feeling of the image transferred onto the paper.

Furthermore, the image forming apparatus having the structure according to the first exemplary embodiment makes the image forming portion 11 the first transparent image-forming portion, forming an image with the clear toner for the image portion, and makes the image forming portion 16 the second transparent image-forming portion, forming an image with the clear toner for the non-image portion. Also, in the case in which the controller 24 carries out the control of the image forming order, therefore, the two image forming portions 11 and 16 form images on different portions of the intermediate belt 21 during one rotation of the intermediate belt 21 (i.e., a period when the intermediate belt 21 passes through the image forming portions once). In other words, two image forming portions 11 and 16 using the clear toner are provided, so that in the case in which the orders of formation of the clear toner and the color toners are to be different in the image portion and in the non-image portion, these toner images are completely formed on the intermediate belt 21 during one rotation of the intermediate belt 21; that is, this is a so-called one-pass process.

Second Exemplary Embodiment

Next, description will be given of an image forming apparatus according to a second exemplary embodiment of the invention.

Figure 4:
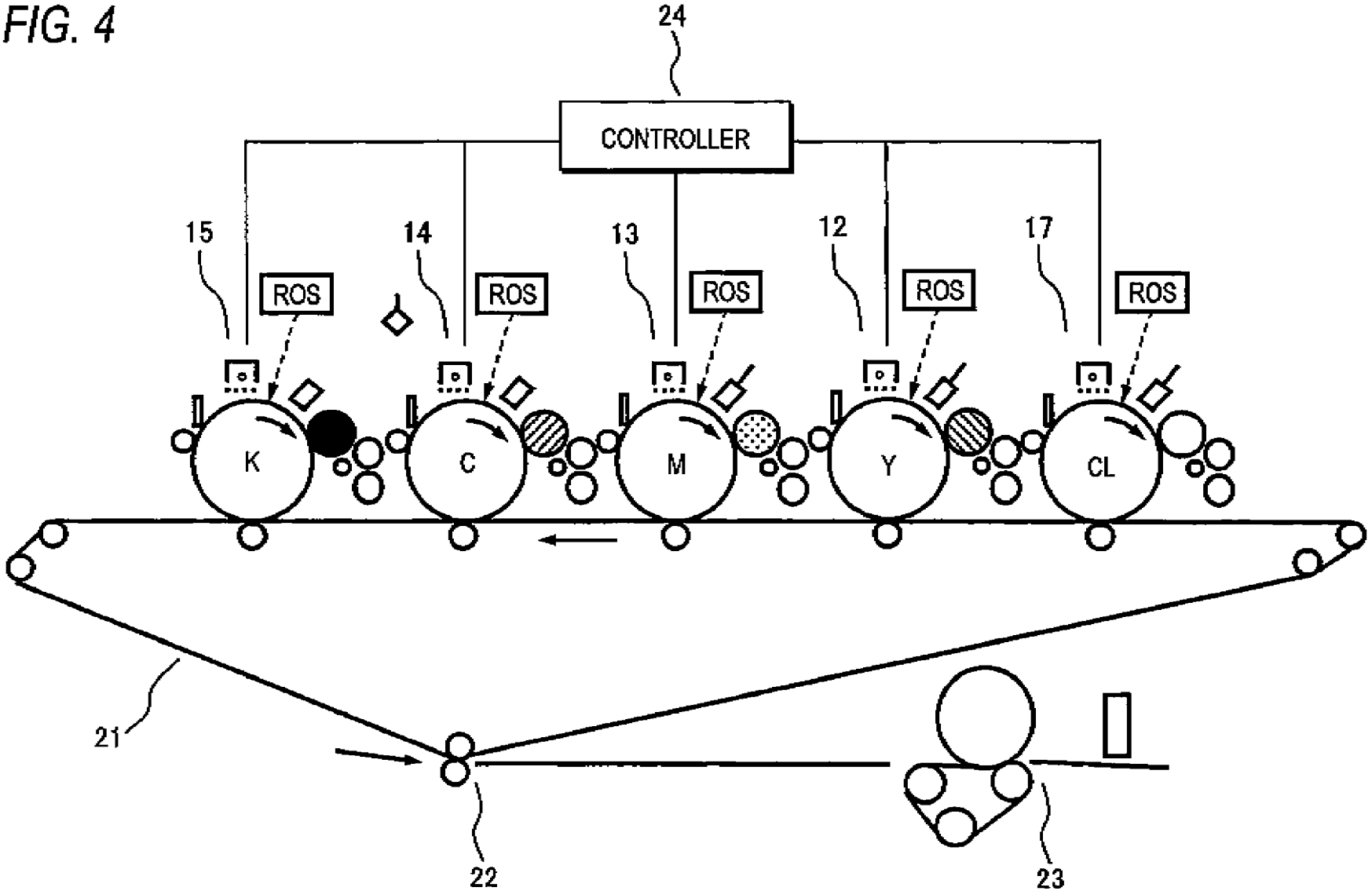
FIG. 4 is an explanatory view showing a structure of a main part in an image forming apparatus according to a second exemplary embodiment of the invention.

FIG. 4 is an explanatory view showing a structure of a main part in the image forming apparatus according to the exemplary second embodiment of the invention.

In the same manner as in the first exemplary embodiment, the image forming apparatus shown in the drawing also employs a so-called "tandem system" in which a plurality of image forming portions 12 to 15 and 17 are arranged in a line.

The image forming apparatus shown in FIG. 4 is different from that according to the first exemplary embodiment in that there is provided only one image forming portion 17 for forming an image using a clear toner which is a transparent material. The single image forming portion 17 is positioned furthest upstream in the carrying direction of an intermediate belt 21 among the image forming portions 12 to 15 and 17.

In other words, the image forming apparatus shown in FIG. 4 specifically includes five image forming portions 12 to 15 and 17.

In the image forming apparatus shown in FIG. 4, moreover, only one image forming portion 17 for forming an image by using the clear toner is provided, and accordingly the configuration for controlling the image forming order with a controller 24 is different from that in the first exemplary embodiment.

Since the other components are the same as those in the first exemplary embodiment, description thereof will be omitted.

Figure 5A:
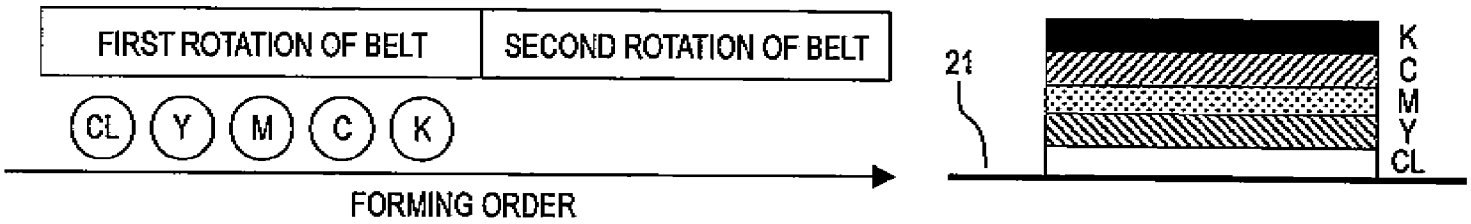
FIGS. 5A and 5B are explanatory views showing an operation control related to an image forming order according to the second exemplary embodiment of the invention.
Figure 5B:
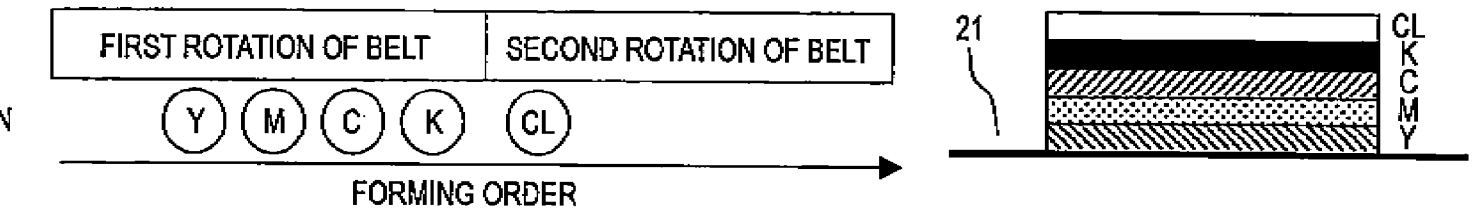

FIGS. 5A and 5B are explanatory views showing an operation control related to the image forming order according to the second exemplary embodiment of the invention.

As shown in FIG. 5A, in the case in which an image is formed in the image portion, the controller 24 gives an operating instruction of image forming to the image forming portion 17 for forming a toner image with a clear toner, the image forming portion 12 for forming a toner image with a Y-color toner, the image forming portion 13 for forming a toner image with an M-color toner, the image forming portion 14 for forming a toner image with a C-color toner, and the image forming portion 15 for forming a toner image with a K-color toner during a first rotation of the intermediate belt 21. As a result, the image forming region on the intermediate belt 21 passes through the primary transferring devices in the image forming portions 11 to 16 in that order so that starting from the intermediate belt 21 surface, the toner image formed with the clear toner, the Y-color toner image, the M-color toner image, the C-color toner image and the K-color toner image are stacked on the intermediate belt 21 in that order.

As shown in FIG. 5B, moreover, in the case in which an image is formed for the non-image portion, the controller 24 does not give an instruction to the image forming portion 17 to form a toner image with the clear toner during the first rotation of the intermediate belt 21. During the first rotation, an instruction to commence operation is given to the image forming portion 12 for forming a toner image with the Y-color toner, the image forming portion 13 for forming a toner image with the M-color toner, the image forming portion 14 for forming a toner image with the C-color toner, and the image forming portion 15 for forming a toner image with the K-color toner. When the intermediate belt 21 starts a second rotation, an instruction of image forming to commence operation is given to the image forming portion 17 for forming a toner image with the clear toner. Consequently, the image forming region on the intermediate belt 21 passes through the primary transferring devices in the image forming portions 11 to 16 in that order so that the Y-color toner image, the M-color toner image, the C-color toner image, the K-color toner image and the toner image formed with the clear toner are stacked on the intermediate belt 21 in that order from the intermediate belt 21 surface.

In other words, in carrying out the operation control related to the image forming order, the controller 24 sets a forming order applying the color toners after the clear toner in the image portion. On the other hand, the controller 24 sets a forming order in which the clear toner is applied last in the non-image portion. Thus, the forming orders of the clear toner and the color toner are caused to be different in the image portion and in the non-image portion.

As described above, in the image forming apparatus having the structure according to the second exemplary embodiment as well, the forming orders of the clear toner and the color toner are different in the image portion and in the non-image portion, in the same manner as in the first exemplary embodiment.

As in the same manner as described with reference to FIG. 3A, accordingly, the color toner layer is efficiently transferred onto the paper in the image portion, while transfer of a fog toner onto the paper is suppressed in the non-image portion. In addition, the clear toner layer is positioned in both the image portion and the non-image portion. After the transfer of the color toner image onto the paper, therefore, it is possible to prevent a difference between the glossy feeling of the image transferred onto the paper in the image portion and the feeling of the non-image portion from occurring.

Moreover, the image forming apparatus having the structure according to the second embodiment includes only one image forming portion 17 for forming an image by using a clear toner which is a transparent material. The single image forming portion 17 is constituted to form an image during the first and the second rotation of the intermediate belt 21. In other words, in the case in which the controller 24 carries out the control of the image forming order, the sole image forming portion 17 forms an image on the intermediate belt 21 during a plurality of rounds (i.e., during a period the intermediate belt passes through the image forming portions a plurality of times), more specifically, two rounds of the intermediate belt 21, that is, a so-called two-pass process including a skip process. Accordingly, in the case in which the order in which the clear toner and the color toners are applied are caused to be different in the image portion and in the non-image portion, it is sufficient that a single image forming portion 17 for forming an image with the clear toner is provided.

Third Exemplary Embodiment

Next, description will be given to an image forming apparatus according to a third exemplary embodiment of the invention.

Figure 6:
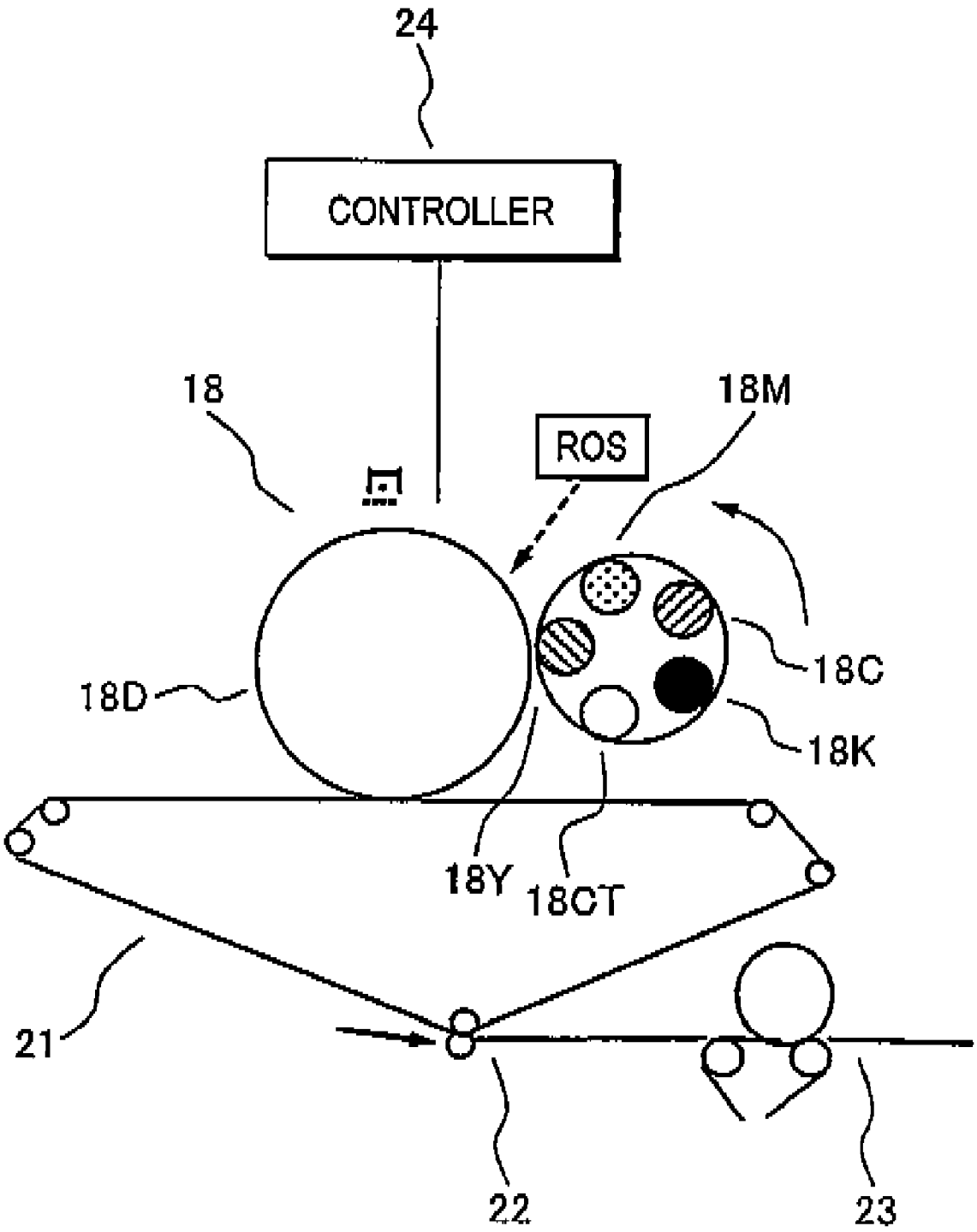
FIG. 6 is an explanatory view showing a structure of a main part in an image forming apparatus according to a third exemplary embodiment of the invention.

FIG. 6 is an explanatory view showing a structure of a main part in the image forming apparatus according to the third exemplary embodiment of the invention.

The image forming apparatus shown in FIG. 6 is different from that in the first or second embodiment in respect to the structure of the image forming portion 18. In other words, the image forming apparatus shown in FIG. 6 employs a so-called "rotary system" in which the single image forming portion 18 is provided.

The image forming portion 18 has a structure in which a plurality of developing devices 18CT, 18Y, 18M, 18C and 18K are disposed on a single photosensitive drum 18D to produce a color image. The developing devices 18CT, 18Y, 18M, 18C and 18K include devices for forming an image with color toners which are coloring materials, and furthermore, a device for forming an image with a clear toner which is a transparent material. In other words, the image forming portion 18 includes the developing device 18Y for developing a Y-color toner image, the developing device 18M for developing an M-color toner image, the developing device 18C for developing a C-color toner image, the developing device 18K for developing a K-color toner image, and the developing device 18CT for developing a clear toner image, and has a structure in which they selectively develop a latent image on the photosensitive drum 18D.

Since a charging device, an exposing device (ROS), a primary transferring device and a cleaning device which are other components of the image forming portion 18 are well-known, description thereof will be omitted.

An intermediate belt 21, a secondary transferring device 22 and a fixing device 23 which are components apart from the image forming portion 18 are the same as those in the first or second exemplary embodiment.

In the image forming apparatus according to the third exemplary embodiment, the image forming portion 18 employs the rotary system. Therefore, a controller 24 carries out control of the order of image forming on the image forming portion 18 which will be described below.

Figure 7A:
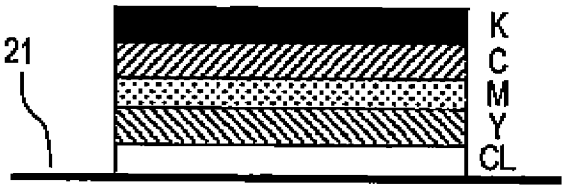
FIGS. 7A and 7B are explanatory views showing an operation control related to an image forming order according to the third exemplary embodiment of the invention.
Figure 7A:
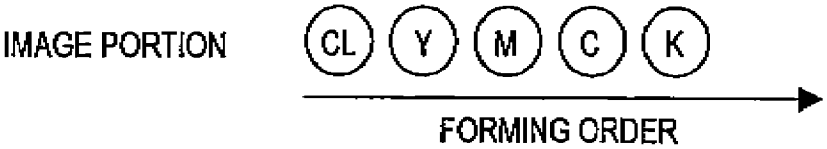
Figure 7B:
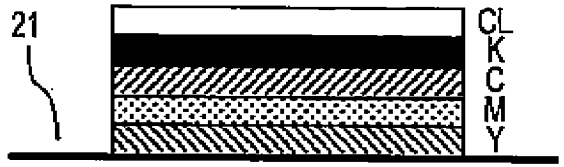
Figure 7B:
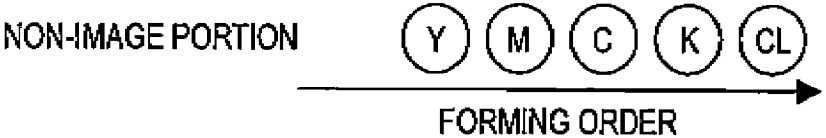

FIGS. 7A and 7B are explanatory views showing control of the image forming order according to the third exemplary embodiment of the invention.

During a first rotation of the photosensitive drum 18D, the controller 24 gives an instruction to the developing device 18CT to develop a clear toner image in an image portion. Consequently, the clear toner image formed on the photosensitive drum 18D is transferred onto the intermediate belt 21 during the first rotation of the photosensitive drum 18D, that is, the first rotation of the intermediate belt 21.

During the second rotation of the photosensitive drum 18D, the controller 24 gives an instruction to the developing device 18Y to develop a Y-color toner image. Consequently, the Y-color toner image formed on the photosensitive drum 18D is transferred onto the intermediate belt 21 during the second rotation of the photosensitive drum 18D, that is, the second rotation of the intermediate belt 21.

During the third rotation of the photosensitive drum 18D, the controller 24 gives an instruction to the developing device 18M to develop an M-color toner image in order to form an image. Consequently, the M-color toner image formed on the photosensitive drum 18D is transferred onto the intermediate belt 21 during the third rotation of the photosensitive drum 18D, that is, the third rotation of the intermediate belt 21.

During the fourth rotation of the photosensitive drum 18D, the controller 24 gives an instruction to the developing device 18C to develop a C-color toner image in order to form an image. Consequently, the C-color toner image formed on the photosensitive drum 18D is transferred onto the intermediate belt 21 during the fourth rotation of the photosensitive drum 18D, that is, the fourth rotation of the intermediate belt 21.

During the fifth rotation of the photosensitive drum 18D, the controller 24 gives an instruction to the developing device 18K to develop a K-color toner image in order to form an image. Consequently, the K-color toner image formed on the photosensitive drum 18D is transferred onto the intermediate belt 21 during the fifth rotation of the photosensitive drum 18D, that is, a fifth rotation of the intermediate belt 21.

During the sixth rotation of the photosensitive drum 18D, the controller 24 gives an instruction to the developing device 18CT to develop the clear toner image again in order to form an image for a non-image portion. Consequently, the clear toner image formed on the photosensitive drum 18D is transferred onto the intermediate belt 21 during the sixth rotation of the photosensitive drum 18D, that is, a sixth rotation of the intermediate belt 21.

By carrying out this serial processing operation, the clear toner image, the Y-color toner image, the M-color toner image, the C-color toner image and the K-color toner image are stacked on the intermediate belt 21 in that order from the intermediate belt 21 surface in the image portion. On the other hand, in the non-image portion, the Y-color toner image, the M-color toner image, the C-color toner image, the K-color toner image and the clear toner image are stacked in that order from the intermediate belt 21 surface.

In other words, in carrying out the control of the image forming order, the controller 24 sets a forming order in which the color toners are applied after the clear toner in the image portion. On the other hand, the controller 24 sets a forming order in which the clear toner is applied last in the non-image portion. Thus, the forming orders of the clear toner and the color toners are caused to be different in an image portion and in a non-image portion.

As described above, also in the image forming apparatus having the structure according to the third exemplary embodiment, the orders in which the clear toner and the color toners are formed are different in the image portion and in the non-image portion in the same manner as the first or second exemplary embodiment.

As described with reference to FIG. 3A, accordingly, the color toner layer is efficiently transferred onto the paper in the image portion, while a transfer of a fog toner onto the paper is suppressed in the non-image portion. In addition, the clear toner layer is formed in both the image portion and the non-image portion. After the transfer of the color toner image onto the paper, therefore, it is possible to prevent a difference from being made between the glossy feeling of the image transferred onto the paper in the image portion and feeling of the non-image portion.

Moreover, the image forming apparatus having the structure according to the third exemplary embodiment adopts a rotary system and includes only one image forming portion 18 having the developing device for developing the clear toner image. The image forming apparatus has a structure in which the image forming portion 18 forms an image while the photosensitive drum 18D and the intermediate belt 21 make a plurality of rotations. Accordingly, in the case in which the forming orders of the clear toner and the color toners are caused to be different in the image portion and in the non-image portion, it is sufficient that one developing device and one image forming portion 18 which form an image by using a clear toner are provided.

Although the description has been given to the suitable examples according to the invention in the first to third exemplary embodiments, the invention is not restricted to the contents thereof.

For example, although the description has been given by taking, as an example, the case in which the color images are formed and output using the Y-, M-, C- and K-color toners in each of the embodiments, it is a matter of course that the invention is not restricted thereto. More specifically, it can be proposed that the invention is applied to a black-and-white machine in entirely the same manner as a color machine.

In other words, the invention is not restricted to the contents described in each of the embodiments but may be properly changed without departing from the scope thereof.

What is claimed is:

1. An image forming apparatus comprising:

an image forming unit that forms an image on an image carrier moving in a first direction with a transparent material and a coloring material;

a controller that controls an order of application of the transparent material to be different between an image portion and a non-image portion that are disposed in an image forming region that extends in a second direction perpendicular to the first direction on the image carrier such that the transparent material is applied to the non-image portion of the image carrier after the transparent material and the coloring material are applied to the image portion; and a transferring unit that transfers the image formed on the image carrier onto a recording medium; wherein the transparent material is only applied to the image portion before the coloring material is applied to the image portion.

2. The image forming apparatus according to claim 1, wherein the controller controls the order of application of the transparent material and the coloring material so that:

the image forming with the coloring material is performed after the image forming with the transparent material for the image portion, and the image forming with transparent material is performed last for the non-image portion.

3. The image forming apparatus according to claim 1, wherein the image forming unit includes:

a first transparent image-forming portion that forms the image with the transparent material in the image portion; and a second transparent image-forming portion that forms the image with the transparent material in the non-image portion, and wherein each of the first transparent image-forming portion and the second transparent image-forming portion forms the image on the image carrier during a period when the image carrier passes through the image forming unit once.

4. The image forming apparatus according to claim 1, wherein the image forming unit includes a single transparent image-forming portion that forms the image with the transparent material, and wherein the single transparent image-forming portion forms the image in the image portion and the non-image portion during a period when the image carrier passes through the image forming unit a plurality of times.

5. A method for image forming, comprising:

forming an image on an image carrier moving in a first direction with a transparent material and a coloring material so that an order of application of the transparent material and the coloring material in the first direction is different between in an image portion and in a non-image portion that are disposed in an image forming region that extends in a second direction perpendicular to the first direction on the image carrier such that the transparent material is applied to the non-image portion of the image carrier after the transparent material and the coloring material are applied to the image portion; and transferring the image on the image carrier onto a recording medium; wherein the transparent material is only applied to the image portion before the coloring material is applied to the image portion.

6. The method for image forming according to claim 5, wherein the image forming with the coloring material is performed after the image forming with the transparent material for the image portion, and the image forming with transparent material is performed last for the non-image portion.

7. The method for image forming according to claim 5, wherein the image forming with the transparent material in the image portion and the non-image portion is performed during a period when the image carrier passes through the image forming unit once.

8. The image forming apparatus according to claim 5, wherein the image forming with the transparent material in the image portion and the non-image portion is performed during a period when the image carrier passes through the image forming unit a plurality of times.

9. The image forming apparatus according to claim 1, wherein the transparent material is applied to the image portion upstream in the first direction of where the coloring material is applied to the image portion and the transparent material is applied to the non-image forming portion downstream in the first direction of where the coloring material is applied to the image portion.

10. The method for image forming according to claim 5, wherein the transparent material is applied to the image portion upstream in the first direction of where the coloring material is applied to the image portion and the transparent material is applied to the non-image forming portion downstream in the first direction of where the coloring material is applied to the image portion.

* * * * *